US012709807B2

(12) United States Patent
Kim et al.

(10) Patent No.: US 12,709,807 B2
(45) Date of Patent: Aug. 18, 2026

(54) PLASMA-RESISTANT TWO-LAYER COATING FILM STRUCTURE AND MANUFACTURING METHOD THEREOF

(71) Applicants: FEMVIX CORP., Hwaseong-si (KR); Ok Ryul Kim, Yongin-si (KR); Ok Min Kim, Yongin-si (KR)

(72) Inventors: Ok Ryul Kim, Yongin-si (KR); Ok Min Kim, Yongin-si (KR)

(73) Assignees: FEMVIX CORP., Hwaseong-si (KR); Ok Ryul Kim, Yongin-si (KR); Ok Min Kim, Yongin-si (KR)

( * ) Notice: Subject to any disclaimer, the term of this patent is extended or adjusted under 35 U.S.C. 154(b) by 301 days.

(21) Appl. No.: 18/707,027

(22) PCT Filed: Mar. 20, 2023

(86) PCT No.: PCT/KR2023/003657

§ 371 (c)(1),
(2) Date: May 2, 2024

(87) PCT Pub. No.: WO2023/182747

PCT Pub. Date: Sep. 28, 2023

(65) Prior Publication Data

US 2025/0154657 A1 May 15, 2025

(30) Foreign Application Priority Data

Mar. 24, 2022 (KR) ..... 10-2022-0036361

(51) Int. Cl.

| | |
|---|---|
| ***B32B 15/04*** | (2006.01) |
| ***B32B 17/06*** | (2006.01) |
| ***C23C 28/04*** | (2006.01) |

(52) U.S. Cl.
CPC ..... *C23C 28/042* (2013.01)

(58) Field of Classification Search
CPC ..... C23C 28/042
(Continued)

(56) References Cited

U.S. PATENT DOCUMENTS

| | | | | |
|---|---|---|---|---|
| 11,939,678 | B2 * | 3/2024 | Nitta | C23C 24/04 |
| 2002/0018902 | A1 * | 2/2002 | Tsukatani | C23C 4/11 428/697 |

(Continued)

FOREIGN PATENT DOCUMENTS

| | | | |
|---|---|---|---|
| JP | 2016-008352 | A | 1/2016 |
| KR | 10-0938474 | B1 | 1/2010 |

(Continued)

OTHER PUBLICATIONS

Lee, Byung-Kuk et al., "Microstructure and properties of yttria film prepared by aerosol deposition", Journal of the Korean Ceramic Society, vol. 46, No. 5, pp. 441-446 (2009).

(Continued)

*Primary Examiner* — Lauren R Colgan
(74) *Attorney, Agent, or Firm* — Bridgeway IP Law Group, PLLC; Sang Ho Lee; Hyun Woo Shin

(57) ABSTRACT

Provided is a plasma-resistant two-layer coating film structure including: a ceramic or metal substrate having pits on a surface thereof; a first coating layer which is a ceramic coating layer formed without cracks on the surface of the substrate by a spray coating method other than thermal spray, the layer being coated to fill the pits on the surface of the substrate, fine pits accompanying ceramic particle bonding being formed on the surface, and the layer including ceramic polycrystalline bodies having a crystallite size of less than 300 nm; and a second coating layer which is a plasma resistant ceramic film, the layer being formed to have a surface roughness (Ra) of 0.2 μm or less without a separate grinding process and coated to cover the fine pits to form a (Continued)

surface in which positions that may serve as starting points of plasma etching are minimized.

20 Claims, 3 Drawing Sheets

(58) Field of Classification Search
USPC ..... 428/701, 702
See application file for complete search history.

(56) References Cited

U.S. PATENT DOCUMENTS

| | | | | |
|---|---|---|---|---|
| 2013/0149471 | A1* | 6/2013 | Kim | B05D 1/12 427/180 |
| 2016/0332921 | A1* | 11/2016 | Iwasawa | C04B 41/87 |
| 2017/0349992 | A1* | 12/2017 | Kim | C23C 4/11 |
| 2019/0027343 | A1* | 1/2019 | Nitta | H01J 37/32495 |

FOREIGN PATENT DOCUMENTS

| | | | |
|---|---|---|---|
| KR | 10-2010-0011576 | A | 2/2010 |
| KR | 10-1108692 | B1 | 1/2012 |
| KR | 10-2013-0044170 | A | 5/2013 |
| KR | 10-1309716 | B1 | 9/2013 |
| KR | 10-2013-0123821 | A | 11/2013 |
| KR | 10-1563130 | B1 | 11/2015 |
| KR | 10-2016-0143532 | A | 12/2016 |
| KR | 10-1817779 | B1 | 1/2018 |
| KR | 10-2019-0057753 | A | 5/2019 |
| KR | 10-2084426 | B1 | 3/2020 |
| KR | 10-2182690 | B1 | 11/2020 |
| KR | 10-2213756 | B1 | 2/2021 |
| KR | 10-2021-0131150 | A | 11/2021 |

OTHER PUBLICATIONS

Iwasawa, Junichi et al., "Plasma-resistant dense yttrium oxide film prepared by aerosol deposition process", The American Ceramic Society, vol. 90, No. 8, pp. 2327-2332 (2007).

* cited by examiner

PLASMA-RESISTANT TWO-LAYER COATING FILM STRUCTURE AND MANUFACTURING METHOD THEREOF

TECHNICAL FIELD

The present invention relates to a two-layer coating film structure formed on a surface of a ceramic or metal substrate to reduce etching by plasma and a manufacturing method thereof.

BACKGROUND ART

It is generally known that for process components exposed to plasma during the semiconductor process, etching occurs preferentially in locally recessed areas (grooves; hereinafter referred to as pits) on the surface of the process components, and as time passes, etching progresses to the entire process components, and etching that starts locally spreads to the entire surface of the process components (Byung-Kuk Lee et al., Non-Patent Document 1).

In addition, a protective layer against plasma etching has been formed by coating the surfaces of the process components exposed to plasma during the semiconductor process with a material that is resistant to plasma (e.g. $Y_2O_3$, Junichi Iwasawa et al., Non-Patent Document 2).

As an example, the technology disclosed in Korea Patent No. 10-2213756 (Patent Document 1) is a technology for forming a plasma protective coating layer on the surface of a substrate (process component) using a thermal spray method. However, there have been disadvantages that coating layers formed by the thermal spray method always contain cracks and pores, and plasma etching begins locally from these cracks and pores as starting points and spreads to the entire process component.

In addition, the technology disclosed in Korea Patent No. 10-0938474 (Patent Document 2) is a technology for forming a coating layer with no cracks and almost no pores on the surface of a process component using an aerosol deposition (AD) method to produce a protective layer against plasma etching.

The technology disclosed in Korea Patent Publication No. 10-2013-0044170 (Patent Document 3) is a technology for providing intersecting scratches with a depth of 1 to 2 μm on the surface of an aerosol deposition layer, in addition to the technology disclosed in Patent Document 2 for forming an aerosol deposition layer exposed to plasma.

The technology disclosed in Korea Patent No. 10-1563130 (Patent Document 4) is a technology for removing valleys and peaks on the surface of process components, forming a coating film, and then removing valleys and peaks on the surface of this coating film, in addition to the technology disclosed in Patent Document 3, and so this is a technology that exhibits more improved plasma resistance than the technologies disclosed in Patent Documents 1, 2, and 3.

The coating films (layers) of Patent Documents 1 to 4 are commonly produced by applying a technology for spaying and coating powder: Patent Document 1 is by a thermal spray method; Patent Documents 2 and 3 are by an aerosol deposition method, and Patent Document 4 is by a spray-coating method other than a thermal spray method.

Meanwhile, coating methods other than a thermal spray method for forming a plasma protective layer include ion-assisted deposition (IAD), plasma reactive deposition (PRD), plasma enhanced chemical vapor deposition (CVD), plasma enhanced evaporation, physical vapor deposition (PVD), and plasma immersion ion process (PIIP) technology (Korea Patent No. 10-1309716, Patent Document 5), and other methods for forming a plasma protective layer include plasma-enhanced CVD (PECVD), PVD, CVD, and atomic layer deposition (ALD) technologies (Korea Patent Publication 10-2016-0143532, Patent Document 6).

The technologies of Patent Documents 1 to 6 commonly include a single-layer plasma protection layer formed on the surface of a process component exposed to plasma.

Meanwhile, there are technologies in which an additional coating layer is formed between the surface of a process component exposed to plasma and a plasma protection layer.

The technology disclosed in Korea Patent 10-1108692 (Patent Document 7) is a technology for forming an aerosol deposition layer of Patent Document 2 on the thermal spray coating layer of Patent Document 1 to have plasma resistance, and a unique feature thereof is that in the processing of the surface of the coating layer formed on the process component, the roughness (average surface roughness of 0.4 to 2.3 μm) was increased through sand blasting so that the aerosol deposition layer adheres well to the thermal spray coating layer.

The technology disclosed in Korea Patent No. 10-2182690 (Patent Document 8) is a technology for forming a thermal spray coating layer on the surface of a process component exposed to plasma, forming a surface molten layer by melting a part of the surface of the thermal spray coating layer, and forming a surface supplementary layer on the molten layer by an aerosol deposition method.

The technology disclosed in Korea Patent No. 10-1817779 (Patent Document 9) is the same as the technology disclosed in Patent Document 7 in the sense that the aerosol deposition layer of Patent Document 2 is formed on the thermal spray coating layer of Patent Document 1 to achieve plasma resistance, but it is different from the technology disclosed in Patent Document 7 in the sense that the thermal spray coating layer and the aerosol deposition layer are subjected to hydration treatment.

The technology disclosed in Korea Patent No. 10-2019-0057753 (Patent Document 10) is the same as the technology disclosed in Patent Document 7 in the sense that the aerosol deposition layer of Patent Document 2 is formed on the thermal spray coating layer of Patent Document 1 to achieve plasma resistance, but it is different from the technology disclosed in Patent Document 7 in the sense that the surface of the thermal spray coating layer is polished.

As mentioned above, the technologies disclosed in Patent Documents 7 to 10 are common technologies for reducing locally initiated plasma etching by forming a thermal spray coating film (layer) (Patent Document 1) with pores and cracks and an aerosol deposition layer (Patent Documents 2 and 3) reducing the pores and cracks on the surface of process components exposed to plasma.

DETAILED DESCRIPTION OF THE INVENTION

Technical Problem

The purpose of the present invention is to provide a plasma-resistant two-layer coating film structure including a first coating layer formed on a surface of a ceramic substrate and a second coating layer formed on the first coating layer to significantly reduce plasma etching.

Technical Solution

To solve the technical problem, the present invention provides a plasma-resistant two-layer coating film structure including: a ceramic or metal substrate having pits on a surface thereof; a first coating layer which is a ceramic coating layer formed without cracks on the surface of the substrate by a spray coating method other than thermal spray, the layer being coated to fill the pits on the surface of the substrate, fine pits accompanying ceramic particle bonding being formed on the surface, and the layer including ceramic polycrystalline bodies having a crystallite size of less than 300 nm; and a second coating layer which is a plasma resistant ceramic film coated by one method of chemical vapor deposition (CVD), physical vapor deposition (PVD), and atomic layer deposition (ALD), the layer being formed to have a surface roughness (Ra) of 0.2 μm or less without a separate grinding process and coated to cover the fine pits to form a surface in which positions that may serve as starting points of plasma etching are minimized, and the layer being crystalline or in a mixed state where both a crystalline phase and an amorphous phase are present.

A semiconductor process component may be applied as the substrate.

The first coating layer may be formed of one or more of $Al_2O_3$, $Y_2O_3$, $Tm_2O_3$, $Gd_2O_3$, $Dy_2O_3$, $Er_2O_3$, and $Sm_2O_3$ to be free of cracks and have pores in an amount of 1% by volume or less and a thickness of 20 μm or less.

The second coating layer may be formed as a ceramic film including yttrium (Y) or a ceramic film including a metal oxide. Specifically, the second coating layer may be formed of one or more of $Y_2O_3$, $YF_3$, yttrium oxyfluoride (YOF), yttrium aluminum (YAG) yttrium aluminum perovskite (YAP), and yttrium aluminum monoclinic (YAM) or may be formed of one or more of $Tm_2O_3$, $Gd_2O_3$, $Dy_2O_3$, $Er_2O_3$, and $Sm_2O_3$ to be free of pores and have a thickness of 15 μm or less. The second coating layer may be formed to have surface hardness (Vickers hardness, Hv) of Hv 500 to Hv 1,500.

The present invention provides a manufacturing method of a plasma-resistant two-layer coating film structure, including: (a) a step of forming a first coating layer by spraying ceramic powder by a spray coating method other than thermal spray onto a ceramic or metal substrate having pits on a surface thereof so that the layer is coated to fill the pits on the surface of the substrate, fine pits accompanying ceramic particle bonding being formed on the surface and the layer including ceramic polycrystalline bodies having a crystallite size of less than 300 nm; and (b) a step of forming a second coating layer which is coated by one method of chemical vapor deposition (CVD), physical vapor deposition (PVD), and atomic layer deposition (ALD) to cover the fine pits to form a surface in which positions that may serve as starting points of plasma etching are minimized, the layer being crystalline or in a mixed state where both a crystalline phase and an amorphous phase are present and made of a ceramic film including yttrium (Y) or a metal oxide and having surface roughness (Ra) of 0.2 μm or less.

The method may further include Step (a-0) of grinding the surface of the substrate before the Step (a), and in the Step (a-0), the surface of the substrate may be ground to have a surface roughness (Ra) of 0.2 μm or less.

The method may further include Step (a-1) of grinding the surface of the first coating layer between the Step (a) and the Step (b), and in the Step (a-1), the surface of the first coating layer is ground to have a surface roughness (Ra) of 0.2 μm or less.

The method may further include Step (a-2) of increasing the thickness of the first coating layer; and Step (a-3) of grinding the surface of the first coating layer with the increased thickness, following the Step (a-1). In the Step (a-2), the thickness of the first coating layer may be increased also by a spray coating method other than thermal spray. In the Step (a-3), the surface of the first coating layer with the increased thickness may be ground to have a surface roughness (Ra) of 0.2 μm or less.

The method may further include Step (c) of heat-treating a two-layer coating film structure, following the Step (b).

Advantageous Effects

By forming a plasma-resistant two-layer coating film structure on the surface of a ceramic or metal substrate according to the present invention, the following effects can be obtained.

1. A first coating layer is formed on the surface of a substrate where pits of several micrometers (μm) to tens of micrometers are present, a plasma resistant ceramic membrane is formed by ceramic coating on the first coating layer on which fine pits (starting points where etching by plasma may be concentrated) that are relatively small compared to the pits on the surface of the substrate are present, and a second coating layer with no or significantly reduced pits where plasma etching may be concentrated is formed so that the plasma resistance of the substrate are ensured.
2. Semiconductor process components on which the plasma-resistant two-layer coating film structure is formed have reduced particle adhesion in processes where plasma is applied.
3. Through the above-described plasma etching and particle reduction, semiconductor manufacturing and processing are be conducted continuously and stably, thereby improving the production yield.
4. The product defect rate is reduced after manufacturing and processing of semiconductors or the like.
5. The external cleaning cycle due to replacement of ceramic or metal substrate is extended.

BEST MODE

Figure 1:
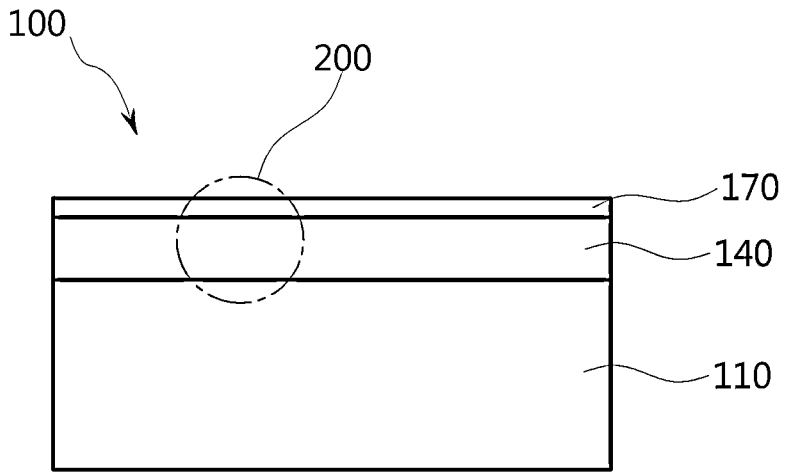
FIG. 1 shows a cross-sectional schematic diagram of a plasma-resistant two-layer coating film structure according to the present invention.

A plasma-resistant two-layer coating film structure including: a ceramic or metal substrate having pits on a surface thereof;

a first coating layer which is a ceramic coating layer formed without cracks on the surface of the substrate by a spray coating method other than thermal spray, the layer being coated to fill the pits on the surface of the substrate, fine pits accompanying ceramic particle bonding being formed on the surface, and the layer including ceramic polycrystalline bodies having a crystallite size of less than 300 nm; and a second coating layer which is a plasma resistant ceramic film coated by one method of chemical vapor deposition (CVD), physical vapor deposition (PVD), and atomic layer deposition (ALD), the layer being formed to have a surface roughness (Ra) of 0.2 μm or less without a separate grinding process and coated to cover the fine pits to form a surface in which positions that may serve as starting points of plasma etching are minimized, and the layer being crystalline or in a mixed state where both a crystalline phase and an amorphous phase are present.

MODES OF THE INVENTION

The technical concept of the present invention may be clearly compared with the above-described Patent Documents 1 to 10.

The above-described Patent Document 1 is a thermal spray method, and a coating layer formed by this technology includes cracks and pores, and plasma etching through the cracks and pores is significant.

The above-mentioned Patent Documents 2 to 4 attempt to implement plasma resistance in a single layer by powder spray coating other than thermal spray. According to this group of technologies, an effect of preventing almost all pores and cracks from occurring in a coating layer is implemented, but fine pits are formed on the surface due to bonding between powder particles during the coating process. The fine pits become weak points where plasma etching is concentrated, and the width and depth of the pits increase at those points as starting points, thereby affecting the substrate.

The above-mentioned Patent Documents 5 and 6 are technologies for implementing plasma resistance by forming a single coating layer using a method other than a powder spray coating method. According to this group of technologies, dense coating is achieved, but the coating layer is formed as a thin film with a small thickness, so the coating layer is formed according to the shape of the pits rather than filling the pits on the surface of a substrate, and the morphological features of this coating layer serve as vulnerability to plasma.

The above-mentioned Patent Documents 7 to 10 attempt to implement plasma resistance with a double layer (thermal spray coating layer+aerosol coating layer) by powder spray coating. On the surface of the aerosol coating layer, which becomes a second layer coating layer, the problem of generating fine pits as described in Patent Documents 2 to 4 is present, and since cracks and pores are inevitably accompanied by the thermal spray coating layer, which becomes a first layer coating layer, the first layer coating layer may not sufficiently prevent the spread of etching that starts from the fine pits formed on the second layer coating layer.

On the contrary, in a plasma-resistant two-layer coating film structure of the present invention, a first coating layer is formed by powder spray coating other than thermal spray, and a second coating layer is formed by methods such as CVD, PVD, and ALD in which a coating layer is formed to be relatively dense (e.g., laminated in units of atoms) compared to the first coating layer.

The present invention allows a first coating layer to fill pits on the surface of a substrate even when there are relatively large pits of several micrometers (μm) to tens of micrometers on the surface of the substrate, and fine particles formed on the surface of the first coating layer are covered with a densely coated second coating layer, thereby minimizing the points where plasma etching is concentrated on the surface of the second coating layer and resulting in significantly superior plasma etching resistance compared to the prior arts (Patent Documents 1 to 10).

Hereinafter, the present invention will be described together with the attached drawings.

I. Plasma-Resistant Two-Layer Coating Film Structure

The present invention provides a plasma-resistant two-layer coating film structure including: a ceramic or metal substrate having pits on a surface thereof; a first coating layer which is a ceramic coating layer formed without cracks on the surface of the substrate by a spray coating method other than thermal spray, the layer being coated to fill the pits on the surface of the substrate, fine pits accompanying ceramic particle bonding being formed on the surface, and the layer including ceramic polycrystalline bodies having a crystallite size of less than 300 nm; and a second coating layer which is a plasma resistant ceramic film coated by one method of CVD, PVD, and ALD, the layer being formed to have a surface roughness (Ra) of 0.2 μm or less without a separate grinding process and coated to cover the fine pits to form a surface in which positions that may serve as starting points of plasma etching are minimized, and the layer being crystalline or in a mixed state where both a crystalline phase and an amorphous phase are present.

The plasma-resistant two-layer coating film structure of the present invention may be manufactured as described in 'II. Manufacturing method of a plasma-resistant two-layer coating film structure,' which will be described later.

The structure of the present invention consists of a first coating layer and a second coating layer sequentially laminated on a ceramic or metal substrate as illustrated in FIG. 1.

As shown in FIG. 1, a plasma-resistant two-layer coating film structure provided by the present invention is a coating film structure consisting of a first coating layer formed on the surface of a ceramic or metal substrate and a second coating layer formed on the first coating layer.

1. First Coating Layer

The first coating layer is a ceramic film including ceramic polycrystalline bodies having a crystallite size of less than 300 nm.

That the first coating layer includes ceramic polycrystalline bodies means that the first coating layer may be formed to be entirely formed to be polycrystalline or may be partially amorphous.

In other words, by the powder spray coating method, which is a method of forming the first coating layer, powder particles may collide with the substrate at a high speed (or initial speed) or the particles may be crushed by collisions between the powder particles, causing the particles to lose crystallinity and change to an amorphous phase, so that an amorphous phase is partially present between crystals.

In addition, unlike a coating film formed by melting ceramic powder particles by a thermal spray coating method, the polycrystalline bodies of the first coating layer are formed as ceramic powder particles are crushed by collision between the particles and the substrate and between the particles, forming polycrystalline bodies having a crystallite size of less than 300 nm.

The crystallite size of the polycrystalline bodies may be confirmed through a transmission electron microscopy (TEM) photograph, and a component analysis of the ceramic film may be confirmed through an energy dispersive X-ray (EDX) analysis.

The first coating layer may be formed of one or more of $Al_2O_3$, $Y_2O_3$, $Tm_2O_3$, $Gd_2O_3$, $Dy_2O_3$, $Er_2O_3$, and $Sm_2O_3$.

Figure 2:
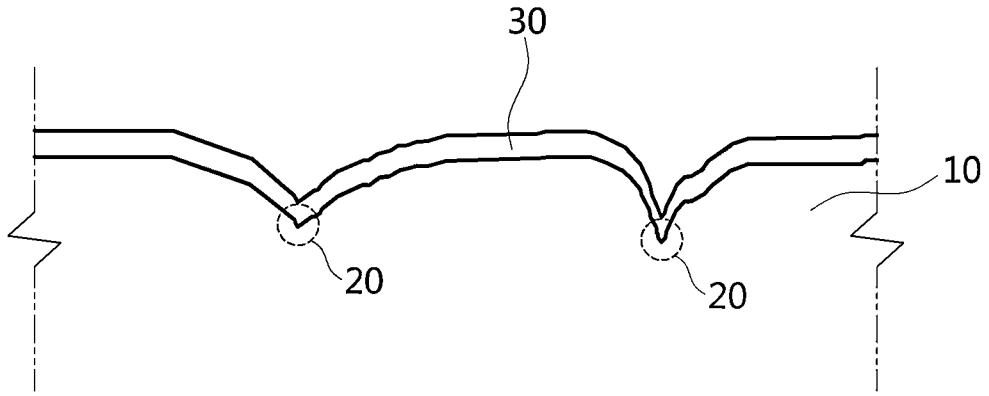
FIG. 2 shows a cross-sectional schematic diagram of a single-layer coating film formed by a conventional PVD, CVD, or ALD method, which is formed according to pits that are present on the surface of a substrate.

Meanwhile, unlike a powder spray coating method, ceramic films formed by a PVD, CVD, or ALD method are generally formed according to the pits on the surface of a substrate as shown in FIG. 2.

Figure 4:
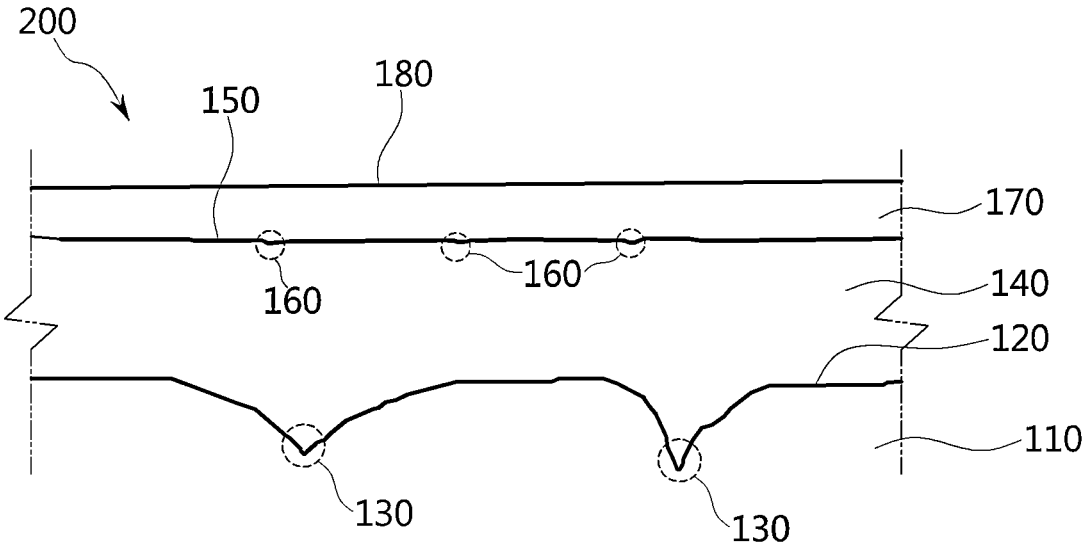
FIG. 4 shows a detailed cross-sectional schematic diagram of a plasma-resistant two-layer coating film structure according to the present invention.

However, as shown in FIG. 4, the first coating layer is formed by filling the pits on the surface of a substrate. However, fine pits may be formed on the surface of a first coating layer during the process of combining ceramic powder particles to form a coating layer.

In addition, a first coating layer according to the present invention has a thickness of 20 μm or less. The thickness of the first coating layer may be confirmed through a scanning electron microscope (SEM) photograph.

Figure 3:
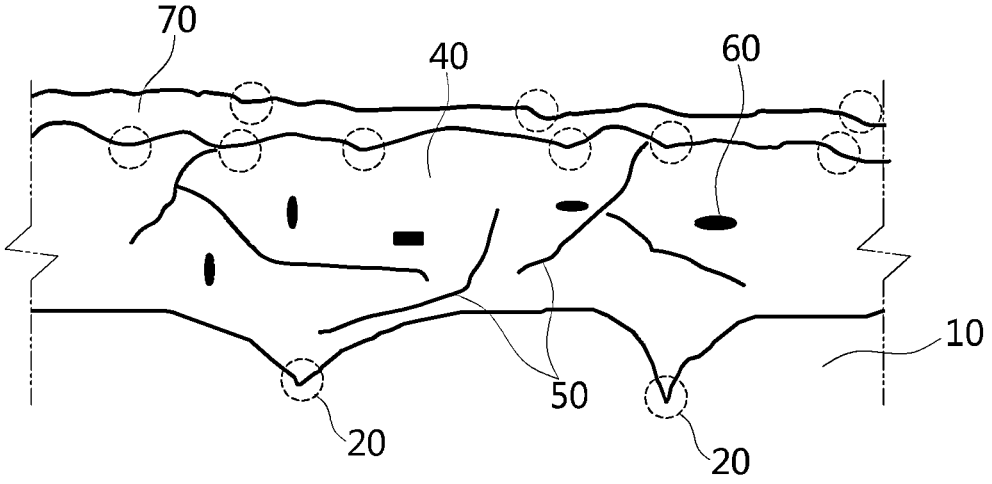
FIG. 3 shows a cross-sectional schematic diagram of a coating film of a conventional thermal spray coating layer and an aerosol deposition layer formed by an aerosol deposition method on the surface of a substrate.

On the other hand, as shown in FIG. 3, a thermal spray coating layer on the surface of a substrate inevitably accompany cracks by the method of melting powder and spray coating, and the first coating layer on the surface of the substrate according to the present invention is free of cracks unlike a thermal spray coating layer. The presence of cracks in the coating layer may be confirmed through a scanning electron microscope (SEM) photograph.

In addition, the first coating layer includes pores in an amount of 1% by volume or less. There are no pores, or even when there are pores, the amount is 1% by volume or less. The presence of pores in the first coating layer may be confirmed by a SEM or TEM photograph.

2. Second Coating Layer

The second coating layer is a plasma-resistant ceramic film formed on the first coating layer. To ensure plasma resistance, it may be formed as a ceramic film including yttrium (Y) or a ceramic film including a metal oxide.

A ceramic film including yttrium (Y) may be formed of one or more of $Y_2O_3$, $YF_3$, yttrium oxyfluoride (YOF), yttrium aluminum (YAG, $Y_3Al_5O_{12}$) yttrium aluminum perovskite (YAP, $YAlO_3$), and yttrium aluminum monoclinic (YAM, $Y_4Al_2O_9$).

The ceramic film including a metal oxide may be formed of one or more of $Al_2O_3$, $Y_2O_3$, $Tm_2O_3$, $Gd_2O_3$, $Dy_2O_3$, $Er_2O_3$, and $Sm_2O_3$.

The second coating layer may be entirely crystalline, or may be in a mixed state where both a crystalline phase and an amorphous phase are present. When the ceramic film is formed by a method such as CVD, PVD, or ALD, a film that is in a mixed state where both a crystalline phase and an amorphous phase are present may be observed, and when the film in such a state is heat-treated, it becomes an overall crystalline film. Whether the ceramic film of the second coating layer is crystalline or in a mixed state where both a crystalline phase and an amorphous phase are present may be confirmed using a TEM photograph or a selected area (electron) diffraction (SAD, SAED) pattern.

As described above, the first coating layer is coated to fill the pits on the surface of a substrate, but fine pits are formed on the surface, and the fine pits of the first coating layer are covered by the second coating layer so that positions that may serve as starting points of plasma etching are minimized, thereby improving plasma resistance.

The second coating layer is formed to have a thickness of 15 μm or less, but the surface hardness (Vickers hardness, Hv) is Hv 500 to Hv 1,500. As the surface hardness increases, plasma resistance (plasma etching resistance) tends to improve. The second coating layer is formed to have a surface roughness (Ra) of 0.2 μm or less.

II. Manufacturing Method of Plasma-Resistant Two-Layer Coating Film Structure

The present invention also provides a manufacturing method of a plasma-resistant two-layer coating film structure, including: (a) a step of forming a first coating layer by spraying ceramic powder by a spray coating method other than thermal spray onto a ceramic or metal substrate having pits on a surface thereof so that the layer is coated to fill the pits on the surface of the substrate, fine pits accompanying ceramic particle bonding being formed on the surface and the layer including ceramic polycrystalline bodies having a crystallite size of less than 300 nm; and (b) a step of forming a second coating layer which is coated by one method of chemical vapor deposition (CVD), physical vapor deposition (PVD), and atomic layer deposition (ALD) to cover the fine pits to form a surface in which positions that may serve as starting points of plasma etching are minimized, the layer being crystalline or in a mixed state where both a crystalline phase and an amorphous phase are present and made of a ceramic film including yttrium (Y) or a metal oxide and having surface roughness (Ra) of 0.2 μm or less.

The above-described section of 'I. Plasma-resistant two-layer coating film structure' described the characteristics of the plasma-resistant two-layer coating film structure provided by the present invention and the phenomena and effects caused by the characteristics. Hereinafter, a manufacturing method of the plasma-resistant two-layer coating film structure will be described.

Figure 5:
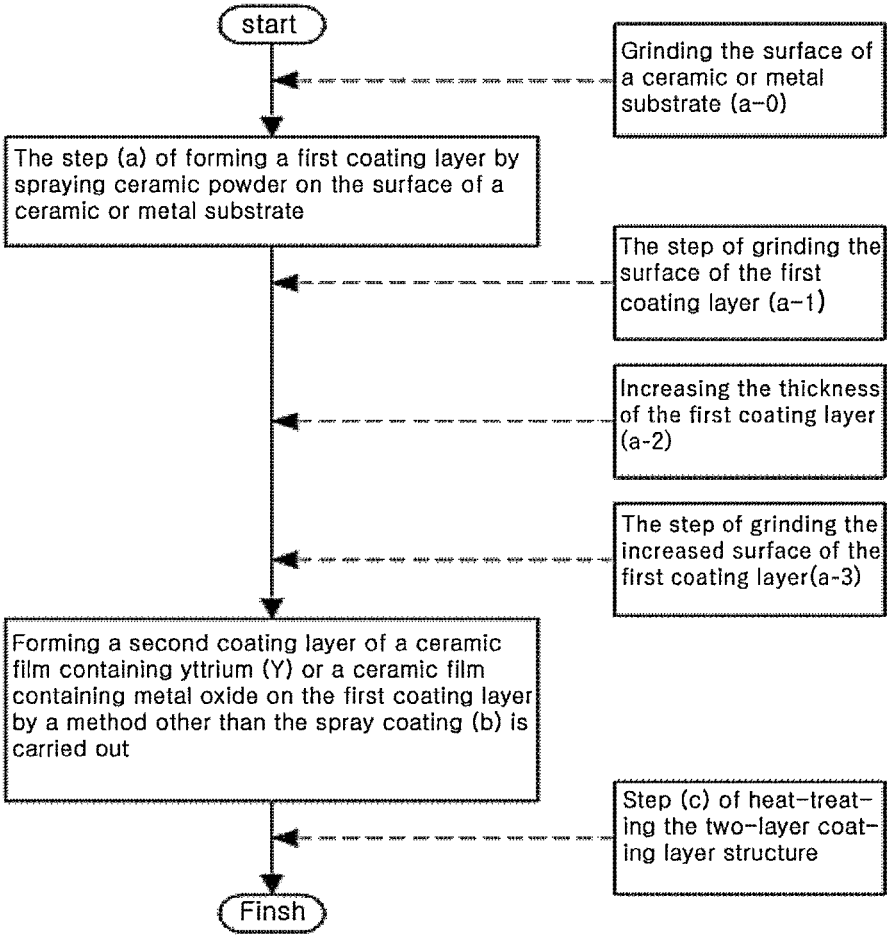
FIG. 5 shows a process flowchart of a manufacturing method of a plasma-resistant two-layer coating film structure according to the present invention.

The plasma-resistant two-layer coating film structure according to the present invention is manufactured by forming a first coating layer and a second coating layer in the process sequence as shown in [FIG. 5].

The Step (a) is a step of forming a first coating layer by spray coating ceramic powder onto a ceramic or metal substrate. As described above, the substrate may be applied to semiconductor processing components.

In the Step (a), the first coating layer may be formed by applying a spray coating method (ALD method, etc.) other than thermal spray.

Before the Step (a), Step (a-0) of grinding the surface of the substrate may further be included to make the pit depth of the surface of the substrate shallow, and in the Step (a-0), the surface of the substrate may be ground to have a surface roughness (Ra) of 0.2 μm or less.

Between the Step (a) and the Step (b), Step (a-1) of grinding the surface of the first coating layer may further be included to make the depth of the find pits on the surface of the first coating layer shallower and make the width narrower. Even in the Step (a-1), the surface of the first coating layer may be ground to have a surface roughness (Ra) of 0.2 μm or less.

Following the Step (a-1), Step (a-2) of increasing the thickness of the first coating layer and Step (a-3) of grinding the surface of the first coating layer with the increased thickness may further be included. In the Step (a-2), the thickness of the first coating layer may be increased also by a spraying coating method other than thermal spray, and in the Step (a-3), the surface of the first coating layer with the increased thickness may be ground to have a surface roughness (Ra) of 0.2 μm or less so that the depth of the fine pits on the first coating layer with the increased thickness is minimized.

The Step (b) is a step of forming a second coating layer consisting of a ceramic film including yttrium (Y) or a ceramic film including a metal oxide by a spray coating method other than thermal spray coating on the first coating layer.

In the Step (b), a second coating layer may be formed by one method of CVD, PVD, and ALD, and the layer being may be formed to have a surface roughness (Ra) of 0.2 μm or less without a separate grinding process In the Step (b), the second coating layer may be formed to have a thickness of 15 μm or less and a surface hardness (Vickers hardness, Hv) of Hv 500 to Hv 1,500. As the surface hardness increases, plasma resistance (plasma etching resistance) tends to improve.

Various modifications and variations of the present invention are possible without departing from the gist of the present invention, and the present invention may be used in various fields. Therefore, the claims of the present invention include modifications and variations falling within the true scope of the previous invention.

INDUSTRIAL APPLICABILITY

A plasma-resistant two-layer coating film structure and a manufacturing method thereof provided by the present invention can be applied to semiconductor industry.

The invention claimed is:

1. A plasma-resistant two-layer coating film structure comprising:

a ceramic or metal substrate having pits on a surface thereof;

a first coating layer which is a ceramic coating layer formed without cracks on the surface of the substrate by a spray coating method other than thermal spray, the layer being coated to fill the pits on the surface of the substrate, fine pits accompanying ceramic particle bonding being formed on the surface, and the layer including ceramic polycrystalline bodies having a crystallite size of less than 300 nm; and a second coating layer which is a plasma resistant ceramic film coated by one method of chemical vapor deposition (CVD), physical vapor deposition (PVD), and atomic layer deposition (ALD), the layer being formed to have a surface roughness (Ra) of 0.2 μm or less without a separate grinding process and coated to cover the fine pits to form a surface in which positions that may serve as starting points of plasma etching are minimized, and the layer being crystalline or in a mixed state where both a crystalline phase and an amorphous phase are present.

2. The plasma-resistant two-layer coating film structure according to claim 1, wherein the substrate is a semiconductor process component.

3. The plasma-resistant two-layer coating film structure according to claim 1, wherein the first coating layer is formed of one or more of $Al_2O_3$, $Y_2O_3$, $Tm_2O_3$, $Gd_2O_3$, $Dy_2O_3$, $Er_2O_3$, and $Sm_2O_3$.

4. The plasma-resistant two-layer coating film structure according to claim 1, wherein the first coating layer is free of cracks.

5. The plasma-resistant two-layer coating film structure according to claim 1, wherein the first coating layer includes pores in an amount of 1% by volume or less.

6. The plasma-resistant two-layer coating film structure according to claim 1, wherein the first coating layer has a thickness of 20 μm or less.

7. The plasma-resistant two-layer coating film structure according to claim 1, wherein the second coating layer is a ceramic film including yttrium (Y) or a ceramic film including a metal oxide.

8. The plasma-resistant two-layer coating film structure according to claim 1, wherein the second coating layer is formed of one or more of $Y_2O_3$, $YF_3$, yttrium oxyfluoride (YOF), yttrium aluminum (YAG) yttrium aluminum perovskite (YAP), and yttrium aluminum monoclinic (YAM).

9. The plasma-resistant two-layer coating film structure according to claim 1, wherein the second coating layer is formed of one or more of $Tm_2O_3$, $Gd_2O_3$, $Dy_2O_3$, $Er_2O_3$, and $Sm_2O_3$.

10. The plasma-resistant two-layer coating film structure according to claim 1, wherein the second coating layer is free of pores.

11. The plasma-resistant two-layer coating film structure according to claim 10, wherein the second coating layer has a thickness of 15 μm or less.

12. The plasma-resistant two-layer coating film structure according to claim 10, wherein the surface hardness (Vickers hardness, Hv) of the second coating layer is Hv 500 to Hv 1,500.

13. A manufacturing method of a plasma-resistant two-layer coating film structure, comprising:

(a) a step of forming a first coating layer by spraying ceramic powder by a spray coating method other than thermal spray onto a ceramic or metal substrate having pits on a surface thereof so that the layer is coated to fill the pits on the surface of the substrate, fine pits accompanying ceramic particle bonding being formed on the surface and the layer including ceramic polycrystalline bodies having a crystallite size of less than 300 nm; and (b) a step of forming a second coating layer which is coated by one method of chemical vapor deposition (CVD), physical vapor deposition (PVD), and atomic layer deposition (ALD) to cover the fine pits to form a surface in which positions that may serve as starting points of plasma etching are minimized, the layer being crystalline or in a mixed state where both a crystalline phase and an amorphous phase are present and made of a ceramic film including yttrium (Y) or a metal oxide and having surface roughness (Ra) of 0.2 μm or less.

14. The manufacturing method of a plasma-resistant two-layer coating film structure according to claim 13, further comprising Step (a-0) of grinding the surface of the substrate before the Step (a).

15. The manufacturing method of a plasma-resistant two-layer coating film structure according to claim 14, wherein in the Step (a-0), the surface of the substrate is ground to have a surface roughness (Ra) of 0.2 μm or less.

16. The manufacturing method of a plasma-resistant two-layer coating film structure according to claim 13, further comprising Step (a-1) of grinding the surface of the first coating layer between the Step (a) and the Step (b).

17. The manufacturing method of a plasma-resistant two-layer coating film structure according to claim 16, wherein in the Step (a-1), the surface of the first coating layer is ground to have a surface roughness (Ra) of 0.2 μm or less.

18. The manufacturing method of a plasma-resistant two-layer coating film structure according to claim 17, further comprising:

Step (a-2) of spraying ceramic powder by a spray coating method other than thermal spray to increase the thickness of the first coating layer; and Step (a-3) of grinding the surface of the first coating layer with the increased thickness, following the Step (a-1).

19. The manufacturing method of a plasma-resistant two-layer coating film structure according to claim 18, wherein in the Step (a-3), the surface of the first coating layer with the increased thickness is ground to have a surface roughness (Ra) of 0.2 μm or less.

20. The manufacturing method of a plasma-resistant two-layer coating film structure according to claim 13, further comprising:

Step (c) of heat-treating a two-layer coating film structure, following the Step (b).

* * * * *